US010245592B2

(12) United States Patent
Kennedy

(10) Patent No.: US 10,245,592 B2
(45) Date of Patent: Apr. 2, 2019

(54) SAFETY AND CONTROL DEVICE, SYSTEM, AND METHOD THEREOF FOR A WASTE PROCESSING SYSTEM

(71) Applicant: Bandit Industries, Inc., Remus, MI (US)

(72) Inventor: Richard S. Kennedy, Mt. Pleasant, MI (US)

(73) Assignee: Bandit Industries, Inc., Remus, MI (US)

( * ) Notice: Subject to any disclaimer, the term of this patent is extended or adjusted under 35 U.S.C. 154(b) by 827 days.

(21) Appl. No.: 14/485,706

(22) Filed: Sep. 13, 2014

(65) Prior Publication Data

US 2015/0102142 A1 Apr. 16, 2015

Related U.S. Application Data

(63) Continuation of application No. PCT/US2013/030946, filed on Mar. 13, 2013, which is a continuation-in-part of application No. 13/318,142, filed as application No. PCT/US2009/049754 on Jul. 7, 2009, now abandoned.

(60) Provisional application No. 61/610,279, filed on Mar. 13, 2012, provisional application No. 61/174,759, filed on May 1, 2009.

(51) Int. Cl.

| | |
|---|---|
| ***B02C 23/04*** | (2006.01) |
| ***B02C 18/22*** | (2006.01) |
| *B02C 18/16* | (2006.01) |

(52) U.S. Cl.

CPC ..... *B02C 23/04* (2013.01); *B02C 18/2291* (2013.01); *B02C 2018/168* (2013.01)

(58) Field of Classification Search

CPC ..... B02C 18/00; B02C 18/18; B02C 18/22; B02C 18/2225

USPC ..... 241/37.5, 92, 100, 101.76

See application file for complete search history.

(56) References Cited

U.S. PATENT DOCUMENTS

| | | | |
|---|---|---|---|
| 3,000,411 | A | 9/1961 | Pierre et al. |
| 3,182,917 | A | 5/1965 | Tamny et al. |
| 3,819,121 | A | 6/1974 | Rogers |
| 3,989,198 | A | 11/1976 | Blasko |
| 4,260,114 | A | 4/1981 | Herder |
| 4,442,877 | A | 4/1984 | Uitermarkt |

(Continued)

FOREIGN PATENT DOCUMENTS

| | | | | |
|---|---|---|---|---|
| BE | 1006930 | A6 | 1/1995 | |
| EP | 1193038 | A2 * | 4/2002 | ..... B27L 11/002 |
| GB | 2098769 | A | 11/1982 | |

*Primary Examiner* — Matthew Katcoff

(74) *Attorney, Agent, or Firm* — Howard & Howard Attorneys PLLC

(57) ABSTRACT

A safety and control system for a wood chipper includes a positional switch having at least a first and second position and a hydraulic valve adapted to provide hydraulic fluid to the feed wheel system thereby powering the feed wheel system when is a first position, and diverting hydraulic fluid to a reservoir, thereby removing power from the feed wheel system, when is a second position, whereby a the valve and the switch are operatively connected such that when the switch is the first position, the valve is in a first position and is adapted to send hydraulic fluid to the feed wheel system, and when the switch is in the second position, the valve is in a second position and is adapted to send hydraulic fluid to the reservoir.

15 Claims, 16 Drawing Sheets

(56) References Cited

U.S. PATENT DOCUMENTS

| | | | | |
|---|---|---|---|---|
| 5,170,313 | A | 12/1992 | Miller et al. | |
| 5,434,457 | A | 7/1995 | Josephs et al. | |
| 5,971,362 | A | 10/1999 | Clark | |
| 5,988,539 | A | 11/1999 | Morey | |
| 6,000,642 | A | 12/1999 | Morey | |
| 6,138,932 | A * | 10/2000 | Moore | A01G 3/002 241/101.76 |
| 6,722,596 | B1 | 4/2004 | Morey | |
| 6,729,567 | B1 | 5/2004 | Morey | |
| 6,814,320 | B1 | 11/2004 | Morey et al. | |
| 6,830,204 | B1 | 12/2004 | Morey | |
| 6,955,310 | B1 | 10/2005 | Morey | |
| 7,011,258 | B2 | 3/2006 | O'Halloran et al. | |
| 7,040,558 | B2 * | 5/2006 | Stelter | A01G 3/002 241/28 |
| 7,044,409 | B2 | 5/2006 | Stelter et al. | |
| 7,083,129 | B2 | 8/2006 | Beam, III | |
| 7,232,083 | B2 | 6/2007 | Stelter et al. | |
| 7,594,620 | B2 | 9/2009 | Abramson et al. | |
| 7,637,444 | B2 | 12/2009 | Stelter et al. | |
| 7,752,924 | B2 | 7/2010 | Kay | |
| 7,819,348 | B2 | 10/2010 | Bouwers et al. | |
| 8,141,802 | B2 | 3/2012 | Galloway et al. | |
| 8,523,095 | B2 | 9/2013 | O'Halloran et al. | |
| 2006/0261195 | A1 | 11/2006 | Beam, III | |
| 2007/0001038 | A1 * | 1/2007 | Bouwers | A01G 3/002 241/34 |
| 2007/0034295 | A1 | 2/2007 | Chapman | |
| 2007/0257141 | A1 | 11/2007 | Stelter et al. | |
| 2007/0267526 | A1 | 11/2007 | Uhrich et al. | |
| 2008/0078851 | A1 | 4/2008 | Stelter et al. | |
| 2008/0135653 | A1 * | 6/2008 | Galloway | B02C 18/145 241/37.5 |
| 2009/0095828 | A1 * | 4/2009 | Bouwers | B02C 18/2225 241/64 |
| 2012/0043404 | A1 | 2/2012 | Morey | |

* cited by examiner

SAFETY AND CONTROL DEVICE, SYSTEM, AND METHOD THEREOF FOR A WASTE PROCESSING SYSTEM

CROSS REFERENCE TO RELATED APPLICATIONS

This application is a continuation of International Application No. PCT/US2013/30946, entitle "SAFETY AND CONTROL DEVICE, SYSTEM, AND METHOD THEREOF FOR A WASTE PROCESSING SYSTEM" which was filed Mar. 13, 2013, now pending, which claims the benefit of the filing date of U.S. Provisional Application Ser. No. 61/610,279 entitled "SAFETY AND CONTROL DEVICE, SYSTEM, AND METHOD THEREOF FOR A WASTE PROCESSING SYSTEM" which was filed on Mar. 13, 2012, each of which are incorporated herein by reference in their entirety. This application is also a continuation in part of U.S. application Ser. No. 13/318,142, entitled "SAFETY AND CONTROL DEVICE, SYSTEM, AND METHOD THEREOF FOR A WASTE PROCESSING SYSTEM" which was filed Oct. 29, 2011, now pending, which is the National Stage of International Application No. PCT/US2009/049754, entitled "SAFETY AND CONTROL DEVICE, SYSTEM, AND METHOD THEREOF FOR A WASTE PROCESSING SYSTEM" which was filed Jul. 7, 2009, now expired, which claims the benefit of the filing date of U.S. provisional application Ser. No. 61/174,759, entitled "SAFETY DEVICE, SYSTEM, AND METHOD THEREOF FOR A WASTE PROCESSING SYSTEM" which was filed May 1, 2009, each of which are incorporated herein by reference in their entirety.

BACKGROUND OF THE INVENTION

The present invention relates to waste processing systems, and more specifically to a safety and control device, system, and methods thereof for a waste processing system.

A variety of machines have been developed to recycle, reduce, or otherwise process wood and brush products. Included therein are machines that chip, cut, grind, or otherwise reduce waste (wood) products including, generally, chippers (disk and drum types), hammer mills, hogs, shredders, grinders, and forestry mowers.

These waste processing systems typically include an infeed system and a waste reducing system, wherein the infeed system is used for directing the waste material to the waste reducing system, the waste reducing system being used for reducing the waste material. Examples of such waste processing machines are disclosed in: U.S. Pat. No. 6,047,912, issued Apr. 11, 2000, entitled "Break-Away Processing Tool For A Waste Processing Machine"; U.S. Pat. Nos. 5,863,003 and 6,299,082; issued Jan. 26, 1999 and Oct. 9, 2001, respectively; all to Smith; and entitled "Waste Processing Machine"; U.S. Pat. No. 6,059,210 issued May 9, 2000 to Smith, entitled "Rotor Assembly For A Waste Processing Machine"; U.S. Pat. No. 6,517,020, issued Feb. 11, 2003 to Smith, entitled "Replaceable Raker Assembly For Processing Tool Of Waste Processing Machine"; U.S. Pat. No. 6,299,082, issued Oct. 9, 2001 to Smith, entitled "Waste Processing Machine"; U.S. Pat. Nos. 6,845,931, 7,121,485, 7,384,011, and 7,726,594; issued Jan. 25, 2005, Oct. 17, 2006, Jun. 10, 2008, and Jun. 1, 2010, respectively; all to Smith; and entitled "Multi-Functional Tool Assembly For Processing Tool of Waste Processing Machine"; and U.S. Pat. No. 7,163,166, issued Jan. 16, 2007 to Smith, entitled "Rotatable Assembly For Machines", all of which are incorporated herein by reference in their entirety.

It is also known to provide a wood chipper for chipping wood such as brush, branches, and the like to produce wood chips. An example of such a wood chipper is disclosed in U.S. Pat. No. 5,988,539, issued Nov. 23, 1999 to Morey, and entitled "Wood Chipper With Infeed Chute Safety Device" which is incorporated herein by reference in its entirety. In these known systems, the wood chipper generally includes an infeed assembly, feed wheel assembly, and a cutting assembly having a rotatable disc or drum with at least one knife or blade for chipping the wood entering the wood chipper and reducing it to wood chips. The chipper also includes a discharge chute for allowing the wood chips to exit the wood chipper, as well as for generally directing them during discharge. Typically, the feed wheel assembly includes: a stationary lower feed wheel, connected to a lower housing; a movable upper feed wheel, connected to an upper housing, and movable relative to the lower housing for allowing wood to enter the cutting assembly. The wood chipper also includes an engine connected to a hydraulic pump, which pumps fluid to drive hydraulic motors to rotate the feed wheels.

Other examples of such wood chippers are disclosed in U.S. Pat. No. 6,032,707, issued Mar. 7, 2000 to Morey et al., entitled "Drum Assembly For A Wood Chipper"; U.S. Pat. No. 6,036,125, issued Mar. 14, 2000 to Morey et al., entitled "Wood Chipper"; U.S. Pat. No. 5,988,539, issued Nov. 23, 1999 to Morey, entitled "Wood Chipper With Infeed Chute Safety Device"; U.S. Pat. No. 6,000,642, issued Dec. 14, 1999 to Morey, entitled "Wood Chipper With Infeed Chute Safety Device"; U.S. Pat. No. 6,722,596, issued Apr. 20, 2004 to Morey, entitled "Multiple Wheel Feed Wheel Assembly For A Wood Chipper"; U.S. Pat. No. 6,357,684, issued Mar. 19, 2002 to Morey, entitled "Adjustable Tension Feed Wheel Assembly For A Wood Chipper"; U.S. Pat. No. 6,830,204, issued Dec. 14, 2004 to Morey, entitled "Reversing Automatic Feed Wheel Assembly For A Wood Chipper"; U.S. Pat. No. 6,814,320, issued Nov. 9, 2004 to Morey et al., entitled "Reversing Automatic Feed Wheel Assembly For Wood Chipper, all of which are incorporated herein by reference in their entirety.

Further, these waste processing systems will generally include a feed control bar which is typically mounted above the infeed chute on a chipper. Generally speaking, these controls bars are multi-positional bars that control the operation of the feed wheels in a forward direction when in a first position, a reverse direction when in a third position, and a neutral or off state when in a second position, wherein the second position is usually disposed between the first and third positions. It is also typical for these bars to be normally biased to the neutral or off state (e.g., the second position), thereby requiring the operator to manually maintain the control bar in the first and third positions, whereby when released the control bar will automatically return to the second position and the feed wheels will be made non-operable.

However, although these types of waste processing systems are useful, in order for these devices to be able to effectuate the reduction of bulk wood products, the systems and machinery used, if operated incorrectly, can be dangerous. For example, the feed system is design to aggressively feed the cutting system, and the cutting system to aggressively reduce the bulk wood products. And, while great care is taken to house and shield these systems, as well as the numerous safety systems, devices and procedures being provided which increase the safety of these machines, these machines can still be dangerous when operated incorrectly and proper safety procedures are not followed.

These safety improvements include devices, systems, and procedures which prevent or otherwise reduce the risks of injury, as for example when these systems are improperly used, and include various shut-offs, pull cords, operational safety bars, and the like. However, as the safety features and procedures of these machines can be improperly used, and while the operator is ultimately responsible for safe operation thereof, the industry desires further safety systems, devices, and procedures in order to still further increase the safety of these machines.

Therefore, there is a need in the art to provide a safety device, system, and method for a waste processing system, including a feed wheel control system that reduces or prevents the risks associated with these prior art waste processing machines. It is also desirable to provide a safety device for a waste processing system that is relatively inexpensive to produce; is easily operable and maintained; is reliable; and can be retrofitted on or to existing waste processing machines in order to help make existing machines safer, as well as being relatively easy to assemble thereto. It is also desirable to provide systems, practices, and methods which increase safety and otherwise establish or promote the safe operation of these waste processing machines. Therefore, there is a need in the art to provide a safety device, system, and method for a waste processing system that overcomes the above-identified disadvantages.

Accordingly, a need exists for novel systems and methods which have, among other advantages, the ability to provide for increased safety while being simple to operate, reliable, easily maintained, and cost effective; which increase safety and otherwise establish and promote the safe operation of these waste processing machines; and are retrofitted so as to be able to be installed, relatively easily, on existing waste processing machines and wood chippers, thereby allowing an aftermarket option for increasing the safety of existing machines. Therefore, systems and methods that solve the aforementioned disadvantages and having the aforementioned advantages are desired.

SUMMARY OF THE PRESENT INVENTION

The aforementioned drawbacks and disadvantages of these former waste processing machines have been identified and a solution is set forth herein by the inventive waste processing machine which includes, a feed wheel shutoff system or control system for a wood chipper having a powered cutting system, a hydraulically powered feed system which includes hydraulic pump and one or more feed wheels and an infeed chute, wherein the control system comprises an actuator which is mounted to an infeed tray of a wood chipper and has at least a first and second position (e.g., two operable positions) upon operator input and activation of the actuator. Also included is a hydraulic valve (e.g., a hydraulic switch comprising a mechanical input) which is fluidly connected, interconnected, or otherwise in fluid communication with the hydraulically powered feed system, the valve being adapted to permit hydraulic fluid to flow within the hydraulically powered feed system so as to allow operation of the feed system (e.g., one or more feed wheels) when the actuator is a first position, and adapted to interrupt (e.g., divert, obstruct, prevent) operation of the feed system (e.g., one or more feed wheels) when the actuator is in the second position, the valve being adapted for mechanical input, so that hydraulic fluid is diverted to flow from the normal hydraulic feed circuit which powers the feed system, to a reservoir thereby removing power from the feed system (e.g., one or more feed wheels). Yet further provided is a linkage (e.g., connection, bar, shaft, rod) which is operatively disposed between and interlinks the actuator and a mechanical input of the valve and thereby provides a direct mechanical connection from and between the actuator to the valve such that when the actuator is in the first position the feed system is operable (e.g., normal operation is maintained and the system is not otherwise acted upon) and when the actuator is in the second position the linkage moves the valve to a second position, whereby the valve is adapted to send or divert the hydraulic fluid to a reservoir thereby making the feed system inoperable.

Further embodiments include an actuator comprising an elongated bar which is hingedly affixed to a forward-feed side of the infeed tray; a biasing device for biasing the actuator (e.g., bar) to the first position; a linkage biased so as to bias the actuator to the first position; a linkage which further comprises a turnbuckle including at least one internal threaded end; wherein further, at least one of the ends of the turnbuckle may comprise an enlarged and generally flat pad. Further yet, the valve may divert hydraulic fluid to a hydraulic storage tank when the actuator, and the valve, is in the second position; and the system may also comprise an override (e.g., disposed between the valve and the storage tank) which is adapted to allow momentary feed wheel operation (e.g., momentary hydraulic flow to the feed wheels) when the actuator (and/or valve) is in the second position; and yet further, the override switch may allow for momentary operation of the feed wheels in a reverse direction. Still further yet, when the actuator is placed in the second position, the valve may be configured so as to require that the valve be manually, physically, and directly reset from the second position, to the first position, or out of the second position.

Also disclosed is a control and safety system which is retrofittable and may be provided in kit form wherein the kit for a feed wheel deactivation system and/or control system for a wood chipper having a powered cutting system, a hydraulically powered feed system and an infeed chute comprises: an actuator for deactivating the powered feed system whereby the actuator is adapted to be actuated via a lower torso of an operator and is adapted to be attached to and positionable on an infeed tray of a wood chipper; a hydraulic directional control valve which controls the flow of hydraulic fluid within a hydraulically powered feed system in response to a mechanical input, the control valve being adapted to be attached to an infeed chute of a wood chipper; and a linkage for mechanically interconnecting the actuator and the control valve, wherein the linkage is adapted to be attached to the infeed tray so as to operatively extend between and operatively connect (e.g., communicate the position of the actuator to the control valve) the actuator and the control valve such that motion from the actuator is mechanically, physically, and directly transferred to the control valve via the linkage.

In yet another embodiment, a wood chipper having a powered cutting system, a hydraulically powered feed system comprising one or more feed wheels and an infeed system comprising an infeed tray and an infeed chute is disclosed wherein the improvement relates to a shutoff and control system which comprises an actuator mounted to an infeed tray of the wood chipper which includes at least a first and second position, wherein the second position is engageable upon an operators input. Also provided is a control valve which is in fluid communication with the one or more feed wheels, the valve being mounted to the infeed chute of the wood chipper and adapted to permit operation of one or more feed wheels when in a first position, while being adapted to interrupt operation of the one or more feed wheels when in a second position and in response to a mechanical input of the valve. This embodiment further comprises a linkage which operatively interlinks the actuator and the mechanical input of the valve and provides a direct mechanical connection between the actuator to the valve such that when the actuator is the first position the valve remains in a first position and when the actuator is moved to the second position the linkage moves the valve to the second position, the valve being adapted to send hydraulic fluid to a reservoir when in such a position.

In still another embodiment, a wood chipper improvement includes an actuator which comprises an elongated bar hingedly affixed to a forward feed side of the infeed tray and which has at least a first and second position, whereby the second position is engageable upon an operators input. The actuator further comprises a biasing device for biasing the bar to the first position. Also provided is a control valve which is in fluid communication with the one or more feed wheels, and which is mounted to the infeed chute of the wood chipper, the valve adapted to permit hydraulic fluid to flow within the hydraulically powered feed system so as to allow operation of one or more feed wheels when in a first position, and adapted to divert hydraulic fluid from the hydraulically powered feed system to a tank or reservoir, thereby diverting hydraulic power from the one or more feed wheels when in a second position, the second position being set in response to a mechanical input. Still further, a turnbuckle is operatively interlinked to the actuator and the mechanical input of the valve thereby providing a direct mechanical connection between the actuator to the valve such that when the actuator is the first position the valve is not act upon and remains in the first position, and when the actuator is moved to the second position the linkage transmits and moves the valve to the second position. Further, the control valve must be manually reset from the second position to the first position, by an operator, via a second actuator.

Further embodiments may also comprise: an override switch disposed on a side of the infeed chute which is adapted to redirect hydraulic fluid so as to allow momentary operation of the one or more feed wheels when the valve is the second position and while engaged/activated; a turnbuckle which comprises an adjustable length and enlarged end pads or bearing surfaces on each end for interaction with the actuator and the valve input.

Yet still further, also disclosed is a method for removing power from a hydraulic feed system of a waste processing machine, the method comprising: providing a switch operatively connected to a hydraulic system of a feed wheel system, the hydraulic system comprising a valve and a reservoir; moving the switch from a first position; diverting hydraulic fluid, in response to the switch being moved from the first position, to the reservoir; whereby when the hydraulic fluid is diverted to the reservoir, the hydraulic fluid that would have powered the feed wheel system is diverted to the reservoir, thereby removing power from the feed wheel system.

Another aspect of the present invention includes a method for removing power from a hydraulic feed system of a waste processing machine, the method comprising: providing a wood chipper having a powered cutting system, a hydraulically powered feed system, and an infeed chute; providing a manually positional switch having at least a first and second position; providing a valve (e.g., hydraulic) adapted to provide hydraulic fluid to the feed wheel system thereby powering the feed wheel system when is a first position, and diverting the hydraulic fluid to a reservoir, thereby removing power from the feed wheel system, when is a second position; providing a connection (e.g., mechanical) operatively disposed between the switch and the valve, such that when the switch is the first position the valve is in a first position and is adapted to send hydraulic fluid to the feed wheel system, and when the switch is in the second position the valve is in a second position and is adapted to send hydraulic fluid to the reservoir; moving the switch from the first position to the second position (or from a first position) thereby moving valve from first position (e.g., an in-use position) to the second position (e.g., a by-pass position) position, thereby diverting hydraulic fluid away from the feed wheels; moving (e.g., via the operator) the switch from the second position to the first position, thereby moving the valve from second position to the first position, thereby diverting hydraulic to the feed wheel system. This embodiment may further comprise: a switch which is disposed on the infeed chute; and/or wherein the switch is disposed on the front bottom of the infeed chute; and/or wherein the switch is an elongated bar extending from a first side of the infeed chute, to a second side of the infeed chute, and along a bottom of the infeed chute; and/or wherein the switch is operatively connected to the valve via a mechanical connection; and further wherein the mechanical connection comprises an adjustable spring operatively connecting the valve and the switch.

In another aspect of the present invention a safety system (e.g., control system) for a wood chipper having a powered cutting system, a hydraulically powered feed system, and an infeed chute is disclosed, wherein the improvement relates to a safety system which comprises: a manually positional switch having at least a first and second position; a hydraulic valve adapted to provide hydraulic fluid to the feed wheel system thereby powering the feed wheel system when is a first position, and diverting hydraulic fluid to a reservoir, thereby removing power from the feed wheel system, when is a second position; a mechanical connection operatively disposed between the switch and the valve, such that when the switch is the first position, the valve is in a first position and is adapted to send hydraulic fluid to the feed wheel system, and when the switch is in the second position, the valve is in a second position and is adapted to send hydraulic fluid to the reservoir. This embodiment may further comprise: a switch which is disposed on the infeed chute; and/or wherein the switch is disposed on the front bottom of the infeed chute; and/or wherein the switch is an elongated bar extending from a first side of the infeed chute, to a second side of the infeed chute, and along a bottom of the infeed chute; and/or wherein the switch is operatively connected to the valve via a mechanical connection; and further wherein the mechanical connection comprises an adjustable spring operatively connecting the valve and the switch.

In yet another aspect of the present invention a wood chipper having a powered cutting system, a hydraulically powered feed system, and an infeed chute is disclosed, wherein the improvement relates to a safety bar which comprises: a positional switch having at least a first and second position, the switch comprising an elongated bar extending from a first side of the infeed chute, to a second side of the infeed chute, and along a bottom of the infeed chute; a hydraulic valve adapted to provide hydraulic fluid to the feed wheel system thereby powering the feed wheel system when is a first position, and diverting hydraulic fluid to a reservoir, thereby removing power from the feed wheel system, when is a second position; a mechanical connection operatively disposed between the switch and the valve, such that when the switch is the first position, the valve is in a first position and is adapted to send hydraulic fluid to the feed wheel system, and when the switch is in the second position, the valve is in a second position and is adapted to send hydraulic fluid to the reservoir. Further, the mechanical connection may also comprise an adjustable spring operatively connecting the valve and the switch.

In still another aspect of the present invention is disclosed a method for retrofitting a waste processing system with a hydraulic feed wheel control system, the method comprising: providing a wood chipper having a powered cutting system, a hydraulically powered feed system, and an infeed chute; providing a manually positional switch having at least a first and second position; providing a hydraulic valve adapted to provide hydraulic fluid to the feed wheel system thereby powering the feed wheel system when is a first position, and diverting the hydraulic fluid to a reservoir, thereby removing power from the feed wheel system, when is a second position; providing a connection operatively disposed between the switch and the valve, such that when the switch is the first position the valve is in a first position and is adapted to send hydraulic fluid to the feed wheel system, and when the switch is in the second position the valve is in a second position and is adapted to send hydraulic fluid to the reservoir; operatively connecting the switch to the waste processing system; operatively connecting the valve to the hydraulic system of the feed wheel system; operatively connecting the switch to the valve.

Other objects, advantages, and features of the invention will become apparent upon consideration of the following detailed description and drawings. As such, the above brief descriptions set forth, rather broadly, the more important features of the present novel invention so that the detailed descriptions that follow may be better understood and so that the contributions to the art may be better appreciated. There are of course additional features that will be described hereinafter which will form the subject matter of the claims.

In this respect, before explaining the preferred embodiment of the disclosure in detail, it is to be understood that the disclosure is not limited in its application to the details of the construction and the arrangement set forth in the following description or illustrated in the drawings. To wit, the waste processing machine of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the claims, unless so claimed.

As such, those skilled in the art will appreciate that the conception upon which this disclosure is based may readily be used as a basis for designing other structures, methods, and systems for carrying out the several purposes of the present invention. It is important therefore that the claims are regarded as including such equivalent constructions, as far as they do not depart from the spirit and scope of the present invention.

Further, the purpose of the Abstract is to enable the United States Patent and Trademark Office, the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any manner.

These and other objects, along with the various features and structures that characterize the invention, are pointed out with particularity in the claims annexed to and forming a part of this disclosure. For a better understanding of the waste processing machine of the present disclosure, its advantages, and the specific traits attained by its use, reference should be made to the accompanying drawings and other descriptive matter in which there are illustrated and described the preferred embodiments of the invention.

As such, while embodiments of the waste processing machine are herein illustrated and described, it is to be appreciated that various changes, rearrangements, and modifications may be made therein without departing from the scope of the invention as defined by the claims.

BRIEF DESCRIPTION OF THE DRAWINGS

As a compliment to the description and for better understanding of the specification presented herein, 16 pages of drawings are disclosed with an informative, but not limiting, intention.

DETAILED DESCRIPTION OF THE PREFERRED EMBODIMENT

The best mode for carrying out the invention is presented in terms of the preferred embodiment, wherein similar referenced characters designate corresponding features throughout the several figures of the drawings.

Figure 1:
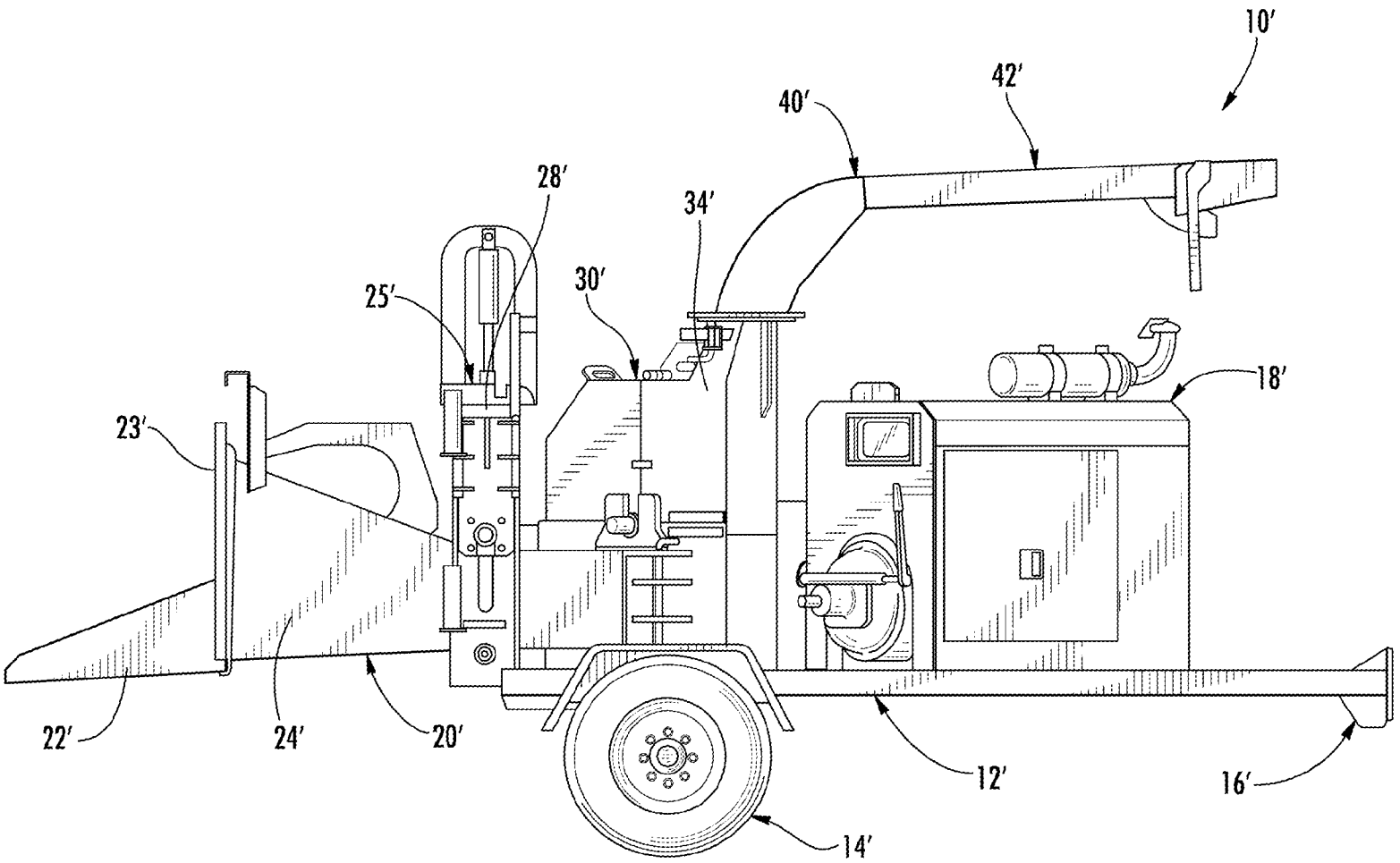
FIG. 1 (PRIOR ART)
FIG. 1 is a side view of an embodiment of a prior art wood chipper comprising a disk type chipping system.

For purposes of description herein, the terms "upper", "lower", "right", "left", "rear", "front", "vertical", "horizontal", and derivatives thereof, shall relate to the invention as oriented in FIG. 1. However, it is to be understood that the invention may assume various alternative orientations, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Reference will now be made in detail to the present preferred embodiments of the invention, examples of which are illustrated in the accompanying drawings. These same referenced numerals may be used throughout the drawings to refer to the same or like parts. Further, like features between the various embodiments may utilize similar numerical designations. Where appropriate, the various similar features may have been further differentiated by an alphanumeric designation, wherein the corresponding alphabetic designator has been changed. Further, the dimensions illustrated in the drawings (if provided) are included for purposes of example only and are not intended to limit the scope of the present invention. Additionally, particular details in the drawings which are illustrated in hidden or dashed lines (if provided) are to be considered as forming no part of the present invention.

As used herein, the terms wood and wood products are meant to be used and defined in their broad, general, and ordinary sense, and the terminology is meant to include trees, brush, trunks, stems, branches, leaves, or the like, or anything else that could otherwise be recycled, reduced, or otherwise processed; and further includes non-naturally occurring or manufactured wood products such as lumber, pallets, or other manufactured products that could otherwise be recycled, reduced, or otherwise processed, as is generally known within the art.

As used herein, the term waste processing system is meant to be used and defined in its broad, general, and ordinary sense. To wit, systems that recycle, reduce, or otherwise process wood products. Included therein are machines that chip, cut, grind, or otherwise reduce wood waste products and include, generally, wood chippers, shredders, grinders, and the like. Of course, this is not meant to be limiting in any manner and these systems may take on numerous configurations, and may be used for numerous purposes as is generally known within the art.

As used herein, the term primary system is meant to be used and defined in its broad, general, and ordinary sense. To wit, the waste processing systems (i.e., sub-systems) which are responsible for the primary operations and/or features of the overall waste processing machine and/or system and included therein is the feed system, the cutting system, and the power supply, source, or engine. Of course, this is not meant to be limiting in any manner and these systems may take on numerous configurations, and may be used for numerous purposes as is generally known within the art.

For the most part hereinafter we will limit our discussion of the invention as related to a wood chipper. However, the inventive embodiments disclosed herein are not meant to be so limited (unless claimed as such), and the systems, devices, and methods disclosed herein may be utilized on any waste processing machine.

With such in mind, as used herein, the term wood chipper is meant to be used and defined in its broad, general, and ordinary sense. To wit, systems that recycle, reduce, or otherwise process wood products. Included therein are machines that chip, cut, grind, or otherwise reduce wood waste products and include, generally, wood chippers, shredders, and the like. Of course, this is not meant to be limiting in any manner and these systems may take on numerous configurations, and may be used for numerous purposes as is generally known within the art.

Referring now to the drawings and to FIG. 1 in particular, a prior art wood chipper is shown generally at 10' and includes a frame 12' supported by a pair of wheels 14', a conventional trailer hitch 16' to allow the chipper to be towed by a vehicle (not shown), and a power source 18'. Supported on frame 12', the wood chipper 10' includes: an infeed assembly or system 20' comprising an infeed tray 22' and an infeed chute 24' to allow wood material to enter the wood chipper; a feed system 25' comprising a feed wheel assembly (not shown), the feed wheel assembly typically comprising at least one feed wheel (not shown) disposed between the infeed system 20' and the cutting system 30' to feed wood material to the cutting system, and one or more feed wheel housings 28'; a cutting assembly or system 30' spaced from the feed system 25' and comprising cutters (not shown) and a cutting assembly housing 34'; and a discharge assembly 40' comprising a discharge chute 42'.

The power source 18' typically comprises an internal combustion engine and provides rotational energy to both the feed wheels (not shown) of the feed system 25' and the cutting disc/drum (not shown) of the cutting system 30'. The engine 18' operatively couples the feed system 25' and cutting system 30' to cause rotation of the feed wheels (not shown) and the rotatable disc/drum (not shown). The engine 18' is typically operated such that the cutting disc/drum (not shown) rotates at a relatively high velocity, while the feed wheels (not shown) rotate relatively slowly. In operation, trees, brush, and other bulk wood products are fed into the infeed chute 24' and captured between, for example, opposed, rotating feed wheels (not shown) of the feed system 25' which feed, pull, or otherwise cause the bulk wood products to encounter the cutting disc/drum (not shown) of the cutting system 30'. The cutting system then reduces the bulk wood products into chips which are expelled through discharge chute 42'.

Figure 1A:
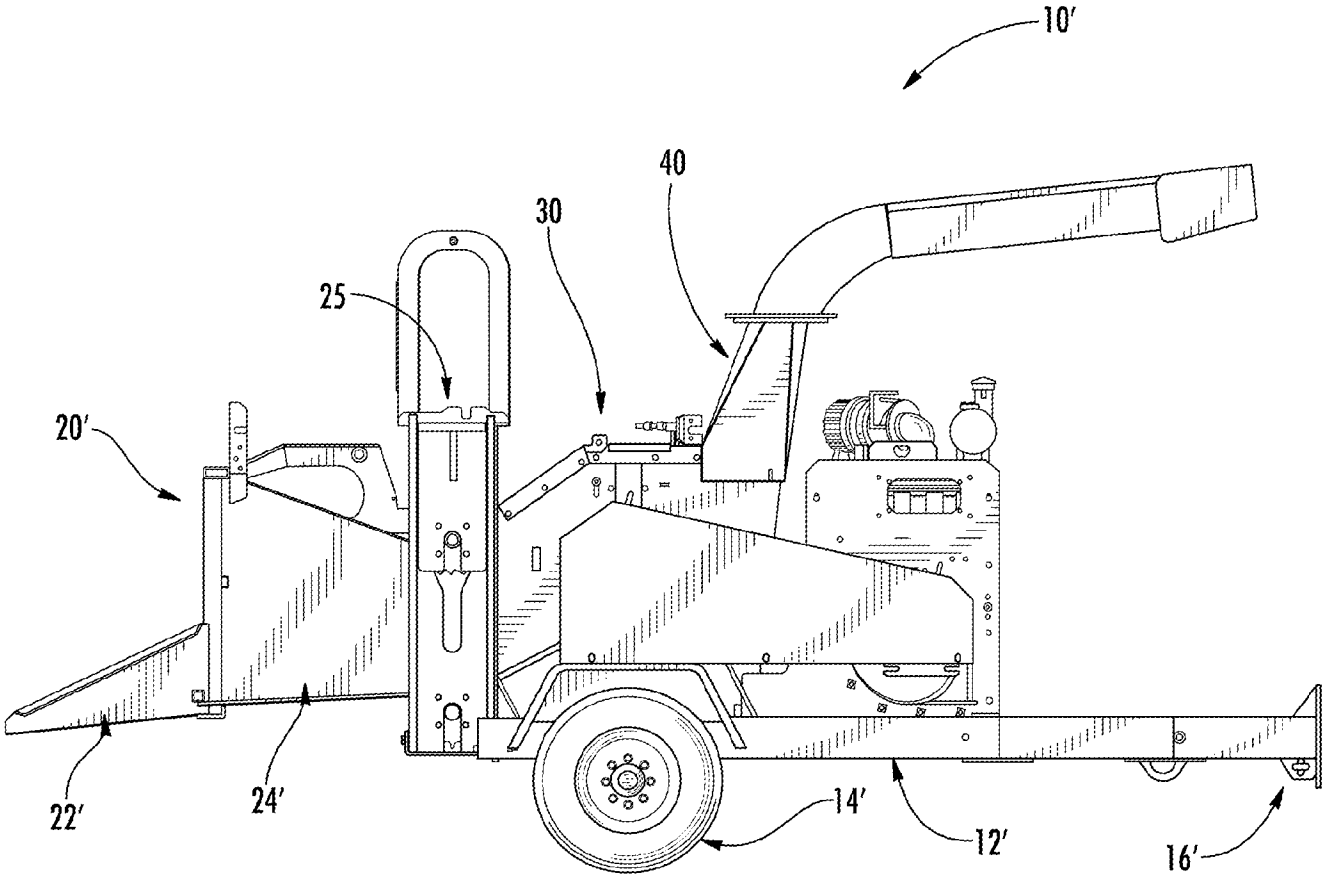
FIG. 1A (PRIOR ART)
FIG. 1A is a side view of another embodiment of a prior art wood chipper comprising a drum type chipping system.

Referring now to FIG. 1A, a prior art wood chipper similar to FIG. 1 is shown generally at 10' and whereas FIG.

1 illustrates a cutting system 30 which includes a disc style cutting/reduction system, FIG. 1A illustrates a drum style cutting/reduction system.

Figure 2:
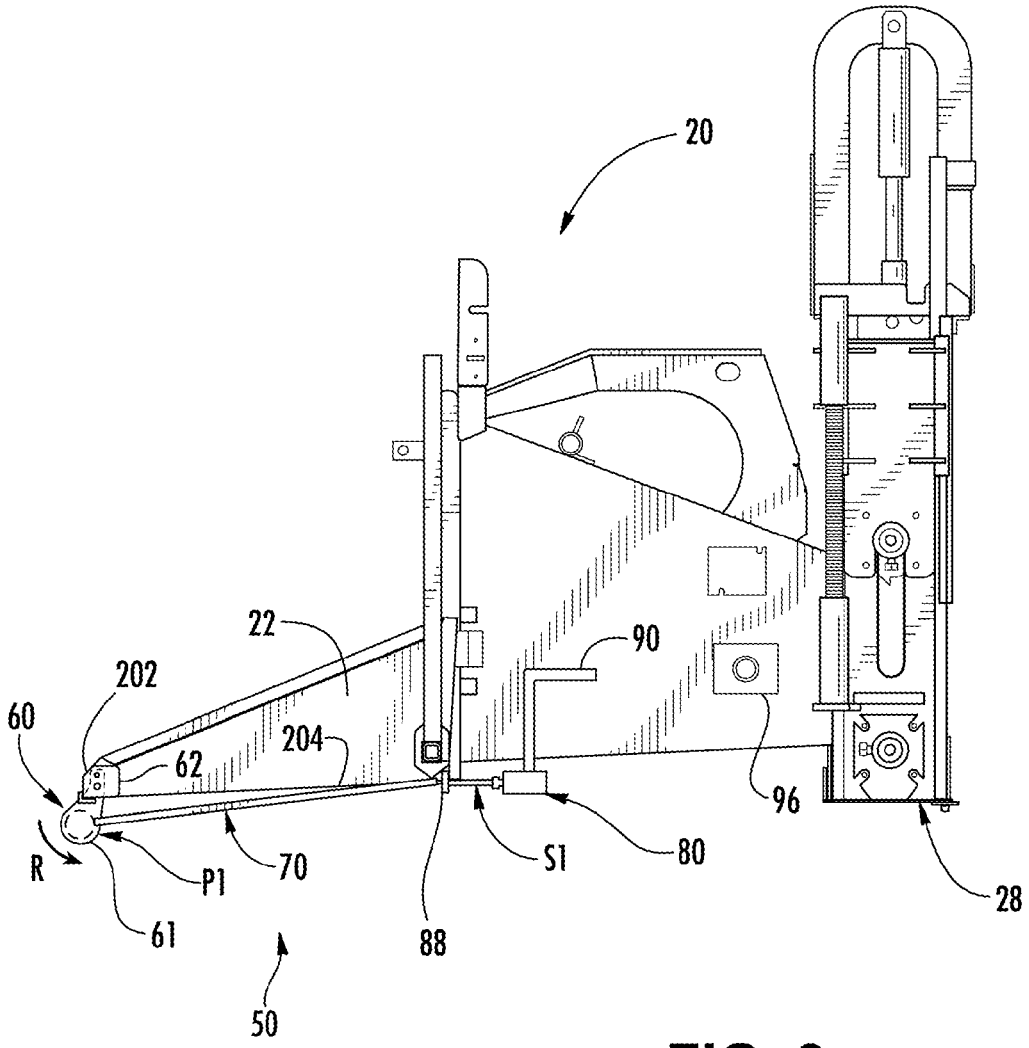
FIG. 2 is a partial side view of a wood chipper illustrating the infeed system and an embodiment of the control system according to one embodiment of the present invention.
Figure 2A:
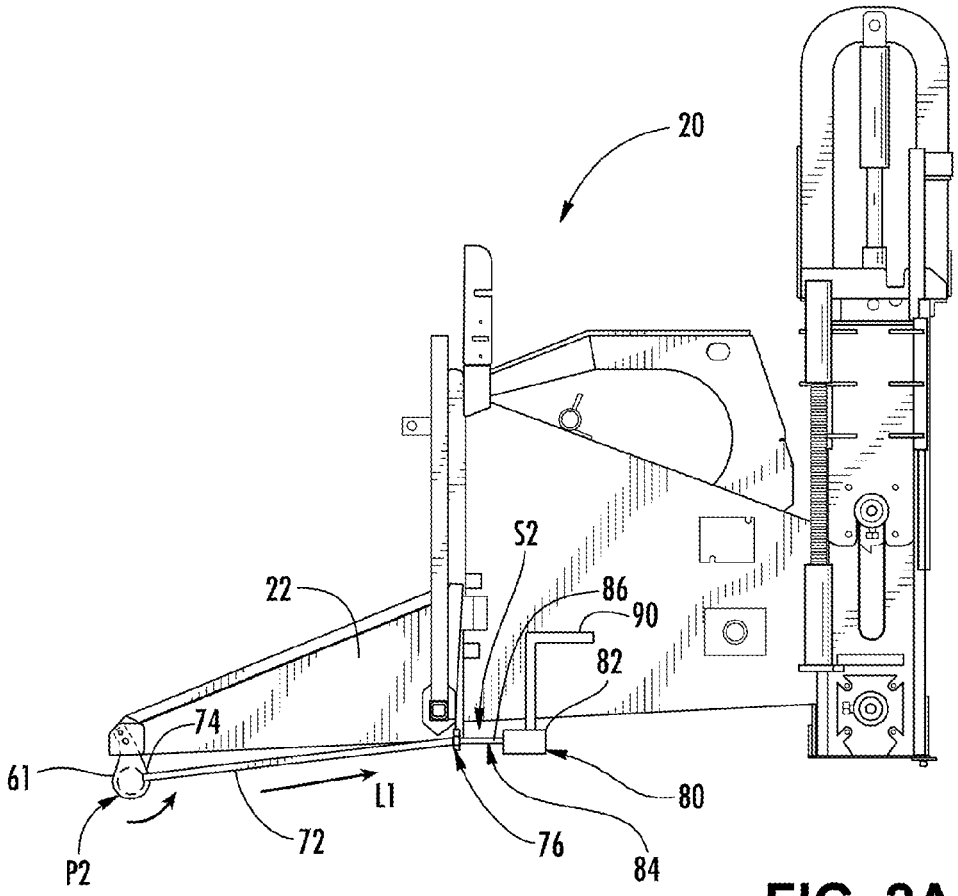
FIG. 2A is a partial side view of the wood chipper of FIG. 2, illustrating the control system in a second position.

Referring now to FIG. 2, the control system 50 comprises an actuator 60 which is attached where appropriate for accessible activation by the operator. In one embodiment the actuator comprises an elongated bar 61 which is attached to a front portion 202 of the infeed tray 22 (e.g., a forward feed side of the infeed tray) via a pair of hinges 62 mounted to respective sides of the infeed tray 22, such that the elongated bar 61 is hingedly disposed below a bottom surface 204 of tray 22 and movable, positionable, and or otherwise able to be actuated via an operator. In this manner the bar 61 can be activated anywhere along the front of the infeed tray 22 for maximum variability. In the exemplary embodiment, the bar 61 is rotatable (via operator input, activation, or actuation) in a direction R from a first position P1 as illustrated in FIG. 2 and to which it is normally biased, to any other second position, for example, to the second position P2 as illustrated in FIG. 2A. Generally speaking the actuator 60 may be any device that is adapted for actuation by an operator (for example, via the lower torso or lower extremities of an operator) including, for example, a switch, bar, actuator, or the like. Further, a biasing device such as a spring may also be provided in order to bias the actuator to the first position.

Control system 50 also comprises a hydraulic valve 80 which is fluidly connected to the hydraulically powered feed system 25 and operatively disposed therein, whereby valve 80 is adapted to provide, permit, and allow hydraulic fluid to flow within the hydraulically powered feed system 25 and the associated one or more feed wheels 26 (not shown) so as to allow operation of the feed system 25 (e.g., feed wheels 26) when the actuator 60 is in the first position P1 and adapted to change, reverse, interrupt, divert, obstruct, or prevent hydraulic fluid flow when not in the first position (e.g., when in position P2), thereby changing, reversing, interrupting, preventing, or otherwise limiting normal operation of the feed system 25 (e.g., feed wheels 26). In one exemplary embodiment, valve 80 comprises a hydraulic directional control valve 82 which includes a mechanical input 84 for control thereof, in this particular example a shaft 86, whereby when the mechanical input 84 is in a first position 51 (as illustrated in FIG. 2) hydraulic fluid is allowed to flow normally to the feed system 25 and associated one or more feed wheels such that normal operation, normal controls, safety devices, etc. are allowed, maintained, or not acted upon. However, when the input 84 is not in the first position 51, for example in a position S2 (as illustrated in FIG. 2A), hydraulic fluid is not allowed to flow normally to the feed system 25, and operation of the one or more feed wheels is thereby effected, made inoperable, reversed, or otherwise changed or acted upon. For example, operation of the one or more feed wheels 26 may be prevented or reversed by effecting, controlling, diverting or preventing the flow of hydraulic fluid thereto.

Figure 3:
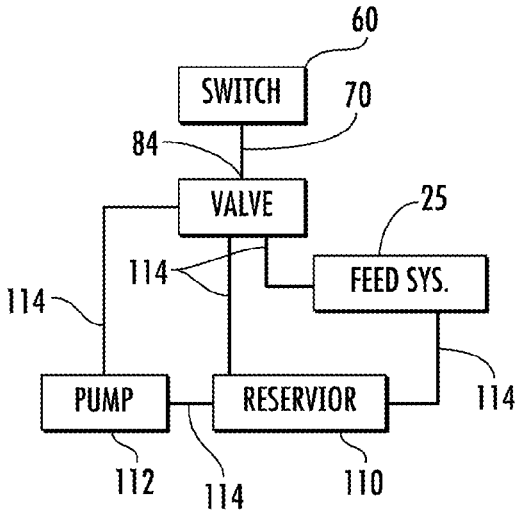
FIG. 3 is a schematic representation of a control system according to one embodiment of the present invention.

In another exemplary embodiment and as illustrated by the hydraulic schematic of FIG. 3, the mechanical valve 80 (e.g., hydraulic directional control valve 82) is linked to the mechanical actuator or switch 60 (e.g., bar 61) via the mechanical linkage 70 (e.g., rod 72). In this manner, movement of the actuator 60 from a position P1 to another position P2 will act to physically, mechanically, or otherwise directly move linkage 70 (via first end 74 acting on, for example, bar 61), whereby the linkage 70 will physically, mechanically, or otherwise directly move input 84 (via second end 76 acting on, for example, input shaft 86), whereby the movement of input 84 physically, mechanically, or otherwise directly changes the flow or direction of flow of hydraulic fluid. In one exemplary embodiment, when the position of shaft 86 is changed to other than S1 (e.g., to S2), hydraulic fluid is diverted from its normal path (e.g., from a reservoir 110, via a pump 112, to the feed system 25 and back to the reservoir) whereby normal operation and control of the wood chipper 10, including normal operation of the one or more feed wheels 26 is interrupted and hydraulic fluid is diverted by valve 80 directly to the reservoir 110 thereby not allowing the one or more feed wheels 26 to operate. Further, this embodiment requires that the valve 80 be manually reset by the operator in order for normal operation to commence. To wit, this embodiment requires that the input shaft 86 be physically, mechanically, or otherwise directly moved from second position S2 to normal or first position 51 in order to resume normal operation of the wood chipper. In one embodiment, this manual deactivation of the valve is accomplished via an override linkage or lever 90 whereby lever 90 must be actuated, the lever being adapted to, upon actuation, physically, mechanically, or otherwise directly move the valve 80 (e.g., input shaft 86) back to input its first or normal position, for normal operation of the wood chipper 10. This may be accomplished for example, by having the lever 90 operatively connected to a mechanical link 92 (see FIG. 6) which is disposed between or otherwise connects linkage 70 to valve input 84. This may for example comprise a "U" shaped connector or toggle disposed between and mechanically connecting linkage 70 and valve input 84, which is operable, positionable, or toggled via the lever 90, or may comprise a slider, or in any other known manner. Generally speaking the valve 80 may be any hydraulic valve comprising a mechanical input for actuation.

Control system 50 also comprises a linkage 70 which is operatively disposed such that the linkage 70 interlinks, connects, and transfers the movement of actuator 60 to the valve 80. In the embodiment illustrated, a rod 72 comprises a first end 74 which interacts with bar 61, and a second end 76 which interacts with valve 80 (e.g., a first end 88 of input 84, more particularly and in this example, a first end 88 of input shaft 86), thereby converting and transferring the rotational motion of bar 61 (via physically, mechanically, or otherwise directly interacting with first end 74) to a linear motion L1 which acts to provide a mechanical input to the valve 80 (via physically, mechanically, or otherwise directly interacting with second end 76). In this manner, a physical, mechanical, or otherwise direct mechanical connection is provided from actuator 60 to valve 80 and therebetween.

Figure 5:
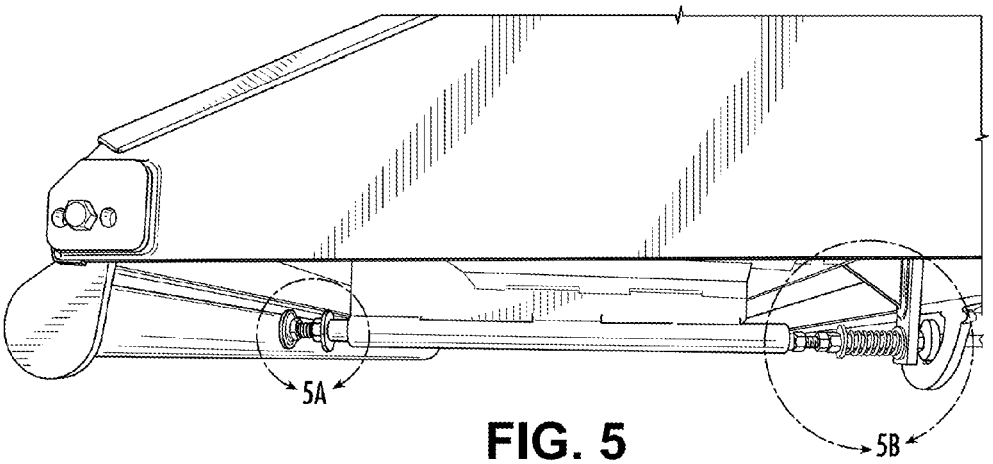
FIG. 5 is a partial side view of the infeed tray and control system according to one embodiment of the present invention.
Figure 5A:
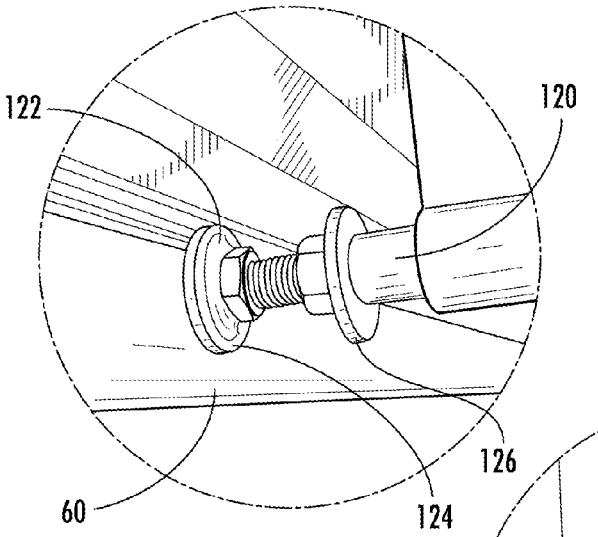
FIG. 5A is an enlarged view illustrating an embodiment of a control linkage of the control system of FIG. 5.
Figure 5B:
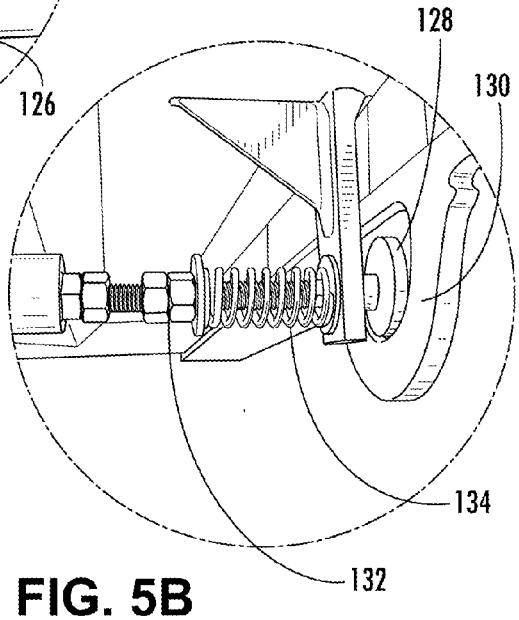
FIG. 5B is another enlarged view illustrating an embodiment of a control linkage of the control system of FIG. 5.

Generally speaking the linkage 70 may be any link, linkage, connection, bar, shaft, rod or the like that is adapted for said connections. And in one embodiment as illustrated in FIGS. 5, 5A, and 5B, a turnbuckle 120 is utilized which comprises a first or lead end 122, an enlarged pad or bearing surface 124 attached to the first end 122, and an adjustment device 126 which in the embodiment illustrated comprises an internally threaded bar. Turnbuckle 120 also includes a second end 128, an enlarged pad or bearing surface 130 attached to the second end 128, and an adjustment device 132 which in the embodiment illustrated comprises an internally threaded bar. Further, one or more ends may also comprise a spring 134 in order to further facilitate adjustment and tensioning. Still further, additional biasing devices such as a spring may also be provided in order to bias the linkage, thereby biasing the actuator 60 to the first position.

Figure 6:
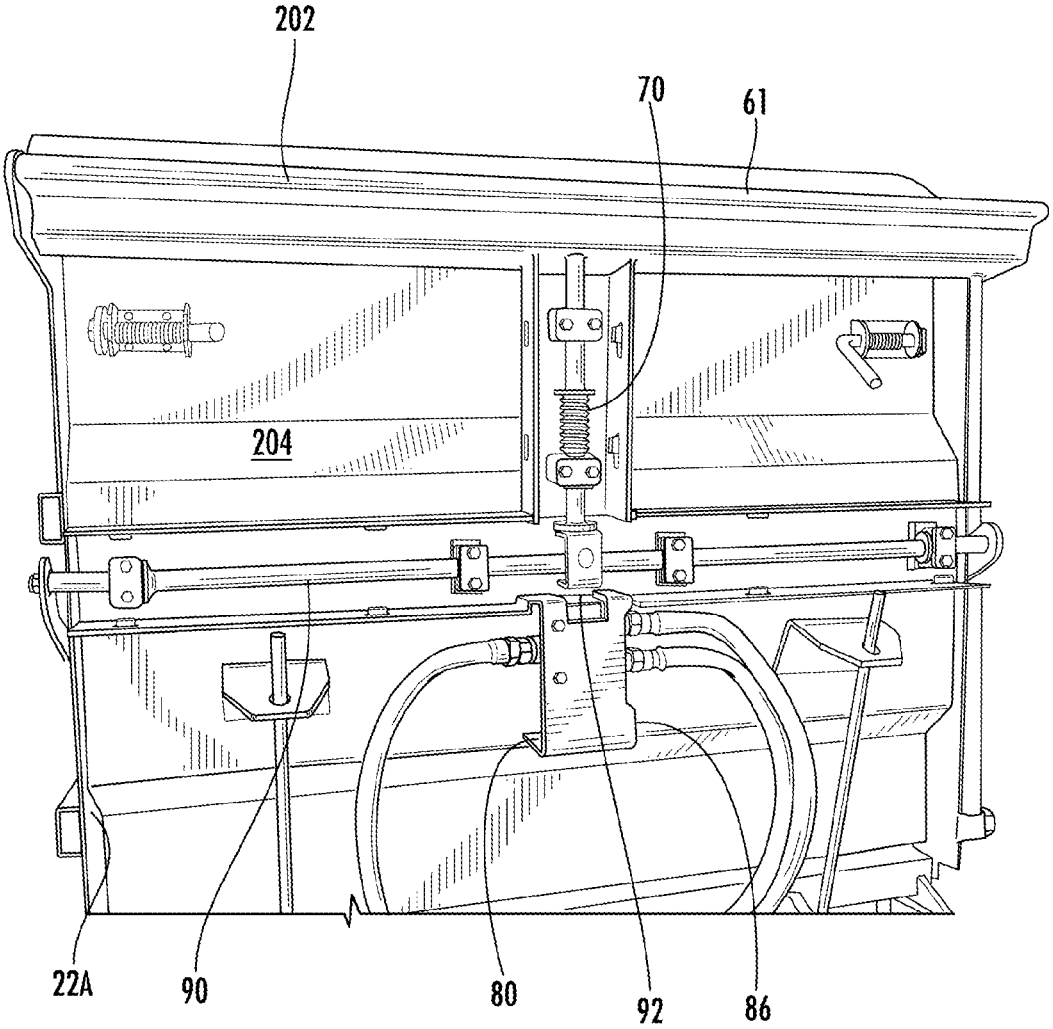
FIG. 6 is a partial bottom view of an infeed tray and control system according to another embodiment of the present invention.

FIG. 6 illustrates another embodiment of the control device, system and feed wheel deactivation system 50 for a wood chipper 10 comprising a non-foldable infeed tray 22A. In this embodiment the control bar 61 is disposed along a front 202 of the tray 22A, whereby the linkage 70, disposed on an underside 204 of tray 22A, is operatively connected to valve input shaft 86 across link 92, whereby link 92 is connected to override bar 90, and via link 92 and bar 90, system 50 is able to be manually reset.

Figure 4:
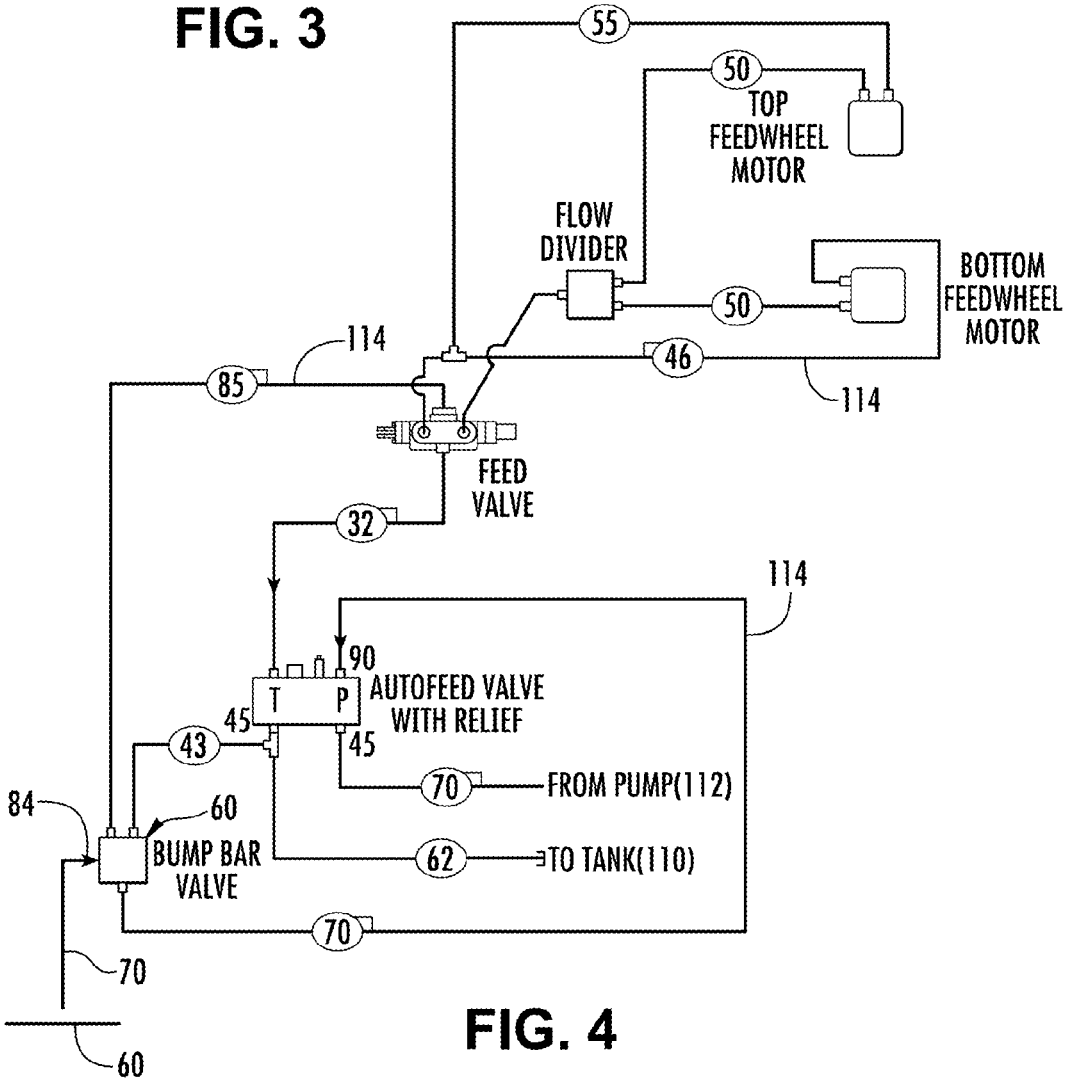
FIG. 4 is a schematic representation of the hydraulics of wood chipper and a control system according to one embodiment of the present invention.
Figure 7:
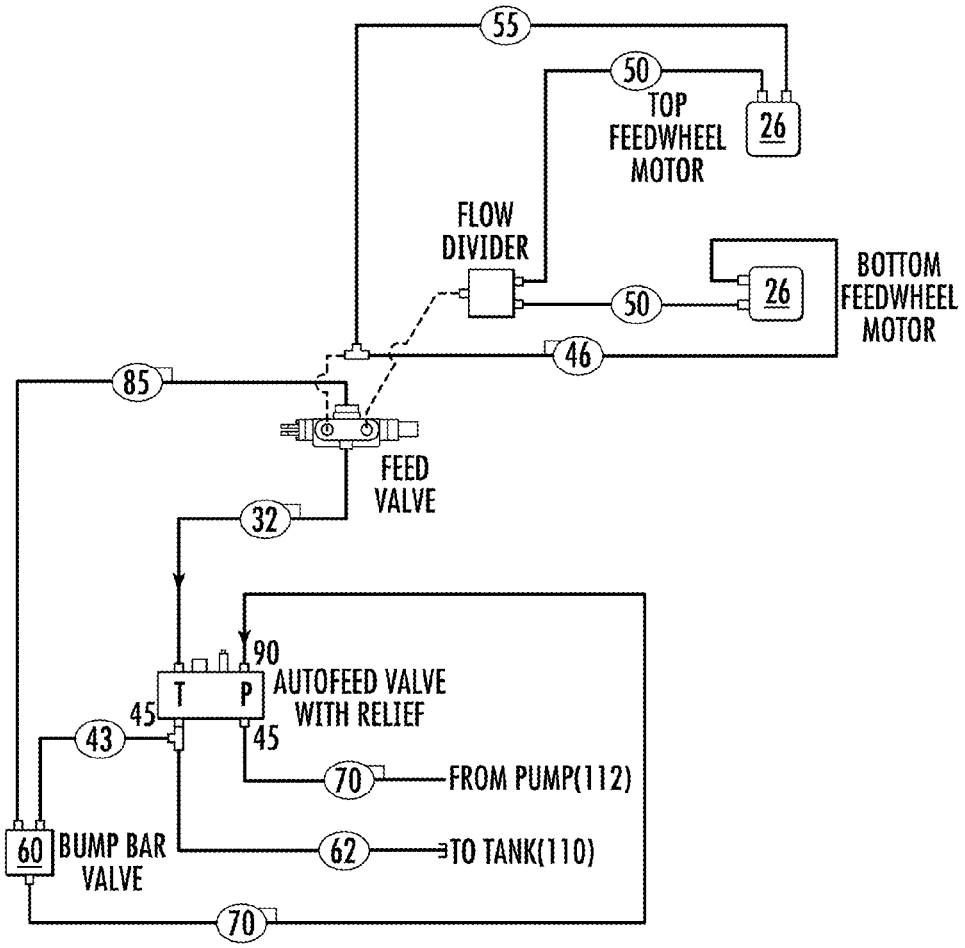
FIG. 7 is another schematic representation of the hydraulics of FIG. 4.

FIG. 7 schematically illustrates the hydraulic flow system of FIG. 4, wherein the circled numbers illustrate exemplary lengths of various hydraulic hosing 114 according to one embodiment of a wood chipper 10.

Figure 7A:
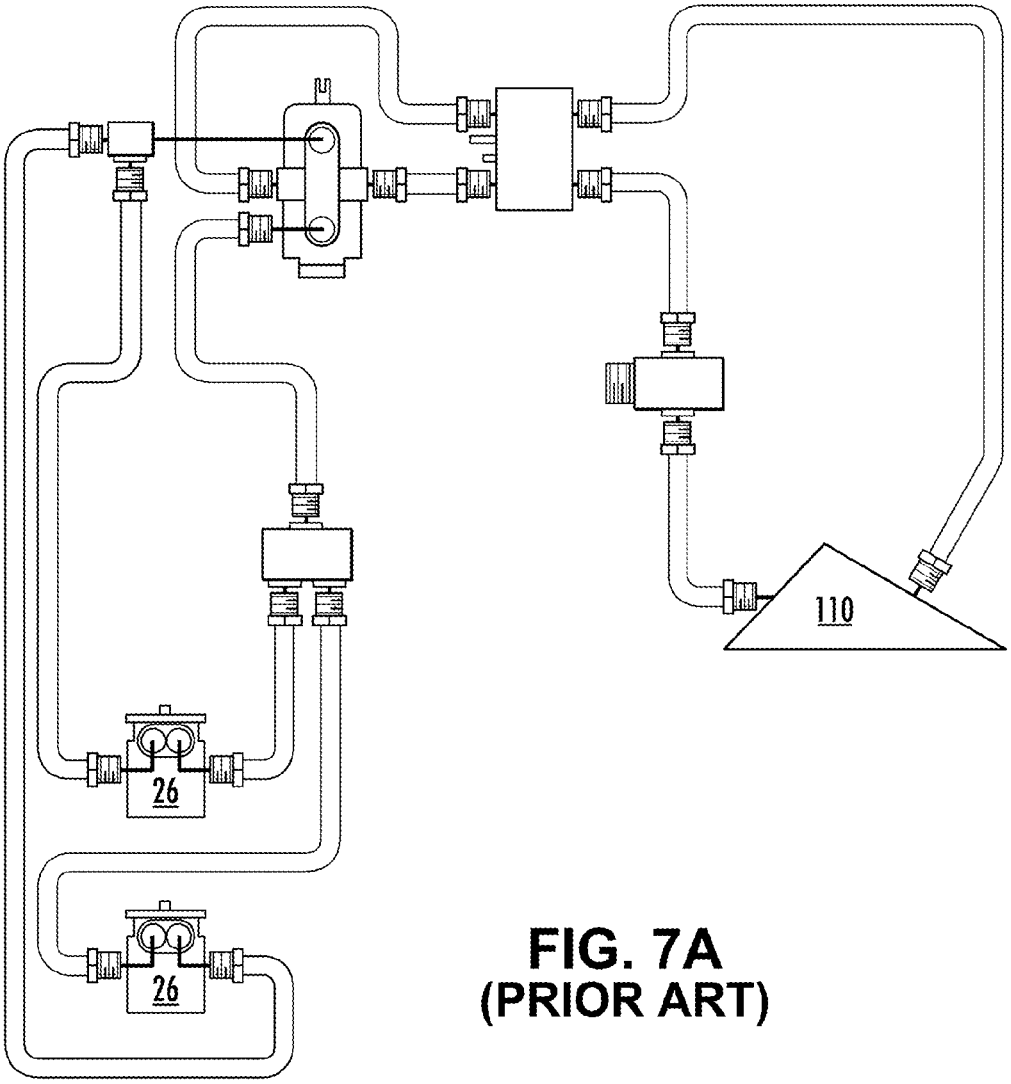
FIG. 7A (PRIOR ART)
FIG. 7A is a schematic representation of the hydraulics of a prior art wood chipper and feed system.

FIG. 7A schematically illustrates the hydraulic flow system of a prior art wood chipper and feed system for comparison.

Figure 8:
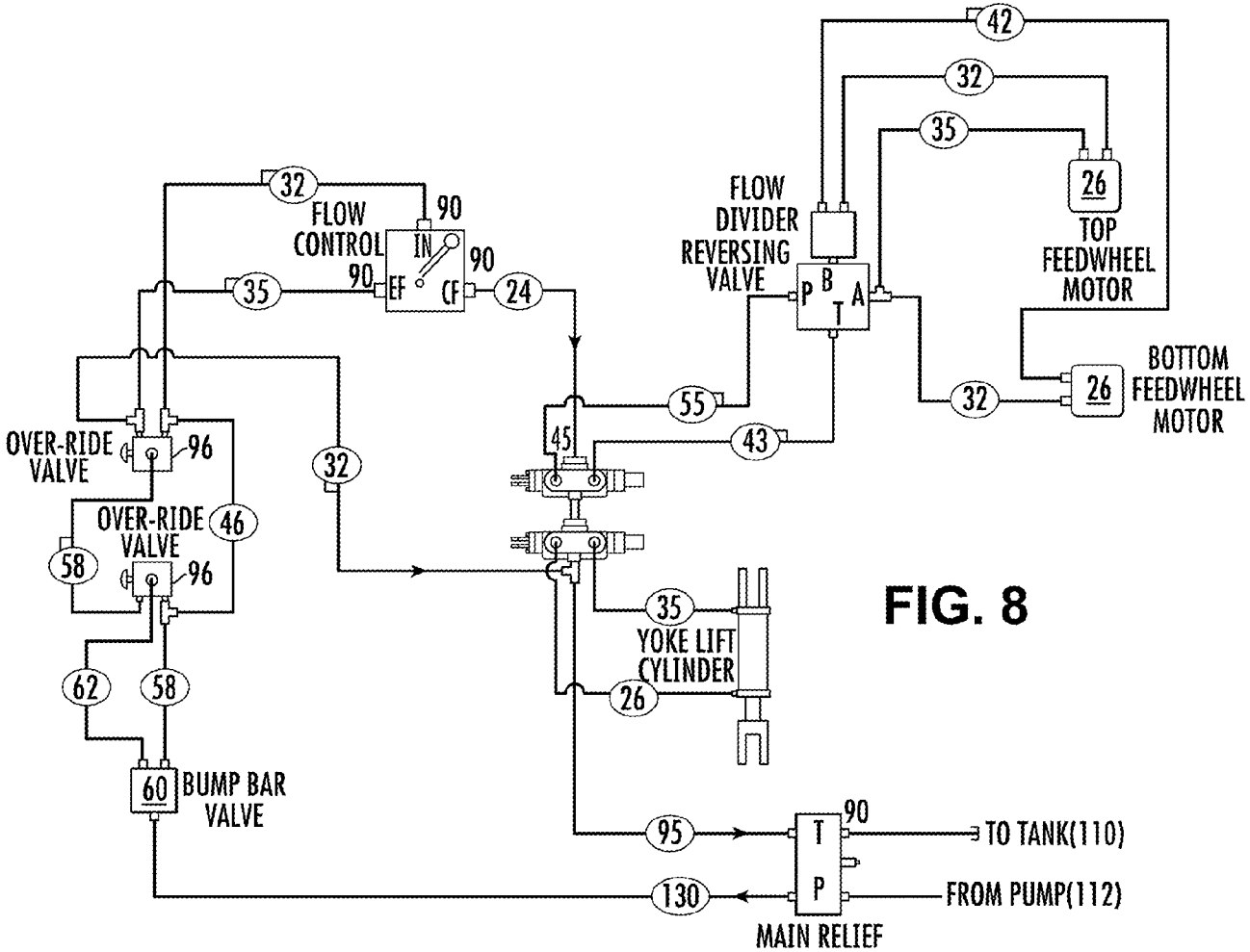
FIG. 8 is a schematic representation of the hydraulics of a wood chipper and a control system according to another embodiment of the present invention.

FIG. 8 illustrates hydraulic flow according to another embodiment which also includes one or more momentary over-ride switches, actuators, levers or the like 96 which are disposed within the hydraulic feed system 25 such that the one or more feed wheels 26 may be operated, for example momentarily, when the valve 80 is in the second, bypass, or diverting mode and while the switch 96 is actuated (for example, depressed). In one embodiment when the switch 96 is depressed to a second position, and only while being depressed, the one or more feed wheels 26 will be allowed to operate only in a reverse. This may be accomplished for example via a mechanically biased valve 96 wherein flow redirection only takes place while the valve 96 is being physically, manually, and directly depressed. In this manner the system 50 remains wholly mechanical in nature and does not requiring any electronic or other non-mechanical systems for operation.

Figure 8A:
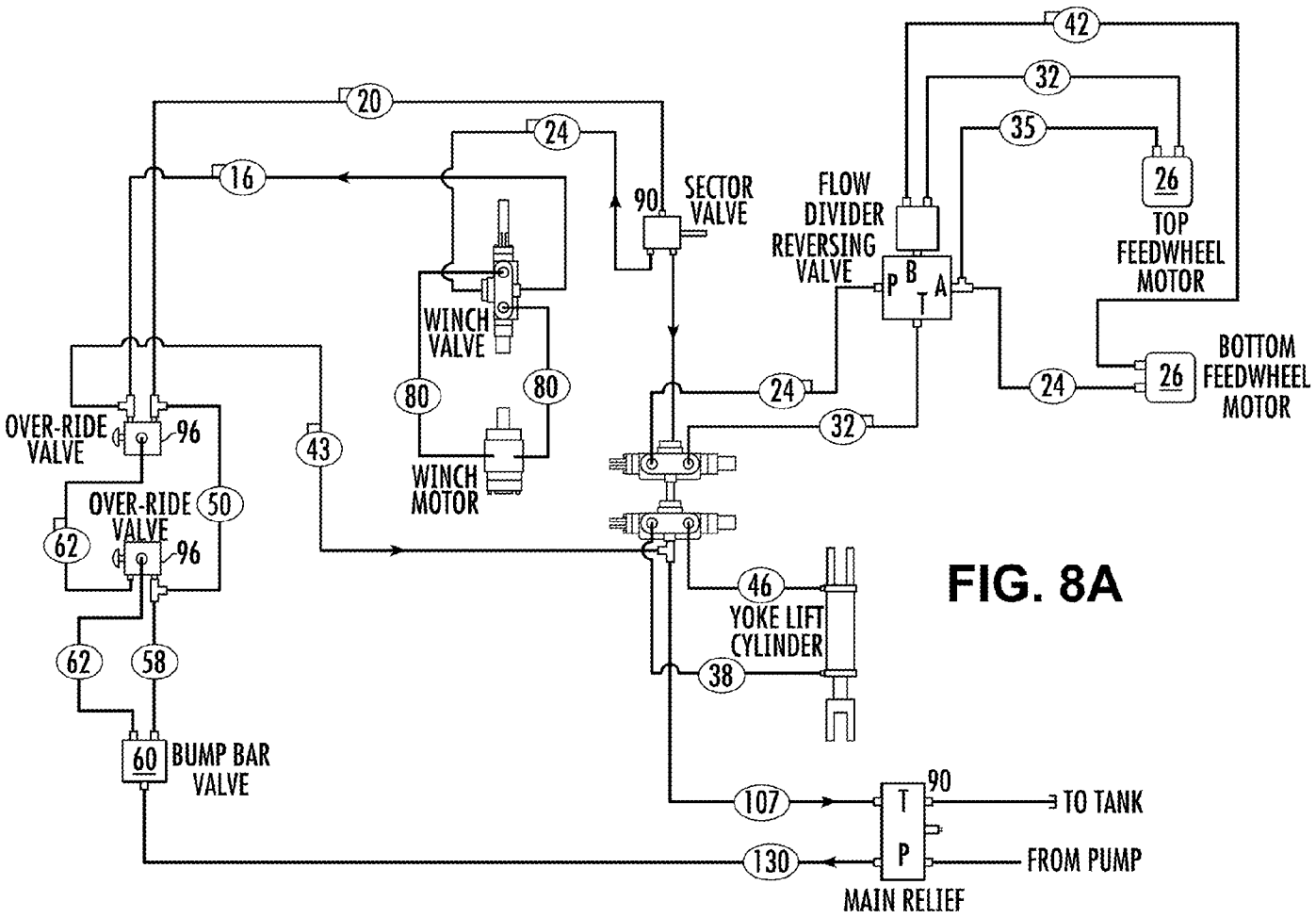
FIG. 8A is a schematic representation of the hydraulics of a wood chipper and a control system according to yet another embodiment of the present invention.

In another embodiment illustrated in FIG. 8A, the addition of a hydraulically powered winch system 140 is provided for and allows for momentary operation of a winch motor 142 to assist with material feeding and/or clearing.

Figure 9:
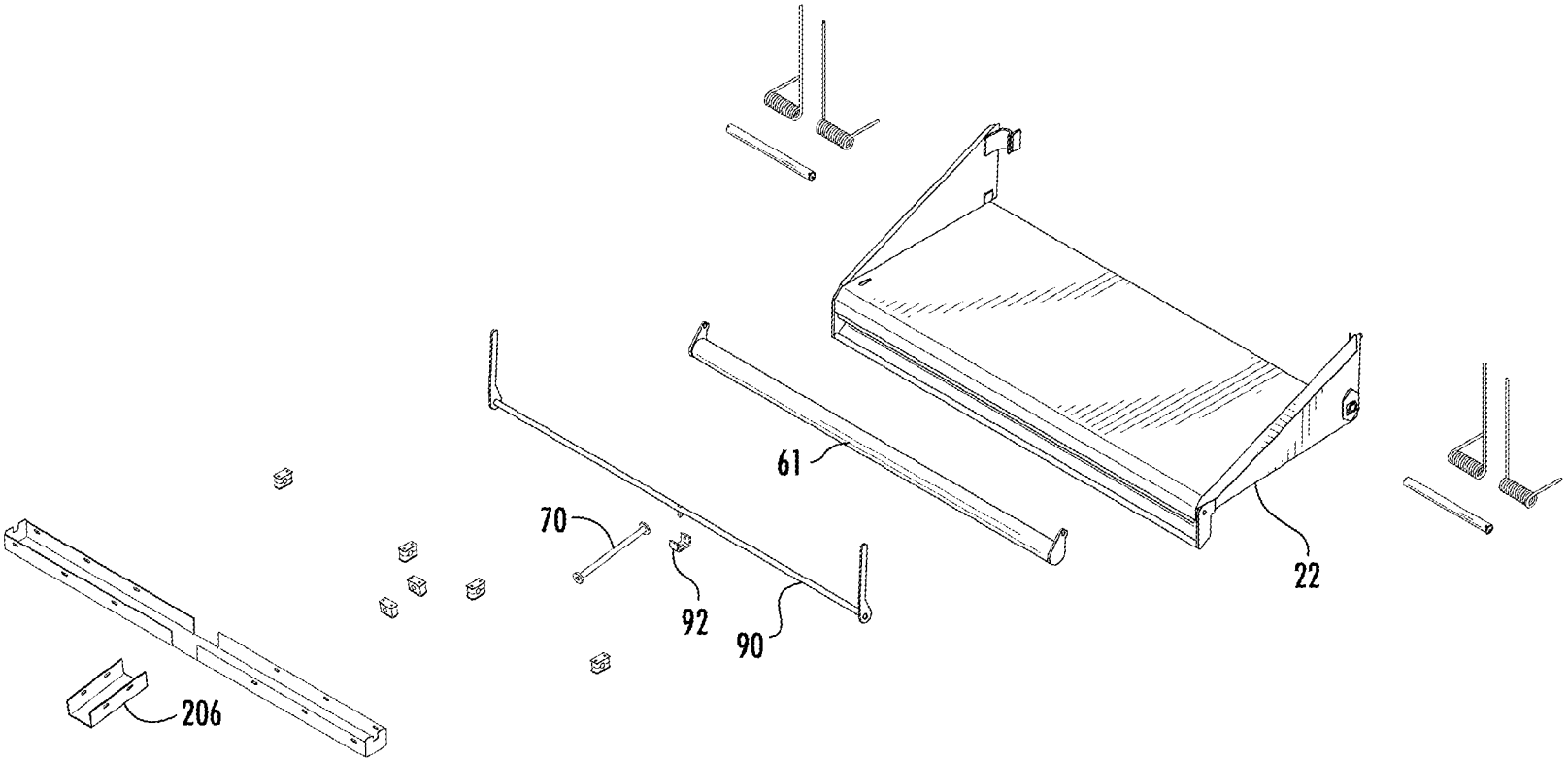
FIG. 9 is a perspective view of associated parts according to an embodiment of the present invention.

FIG. 9 illustrates an exemplary embodiment of the components of a retrofittable kit 200 and may comprise, for example, the actuator 70, over-ride 90, linkage 70 and housings or covers 206.

Figure 10:
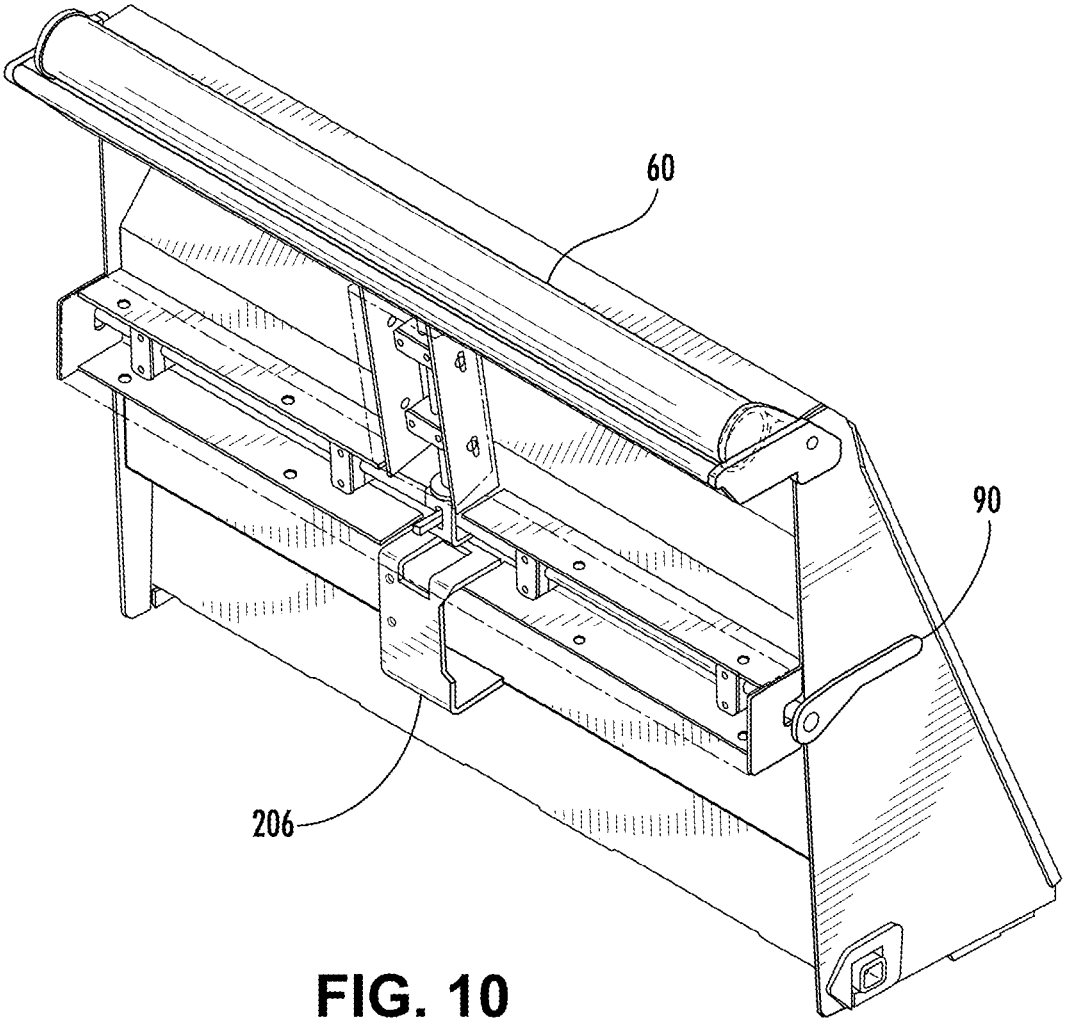
FIG. 10 is a bottom perspective view of an underside of a feed tray illustrating the covers and override lever according to an embodiment of the present invention.
Figure 11:
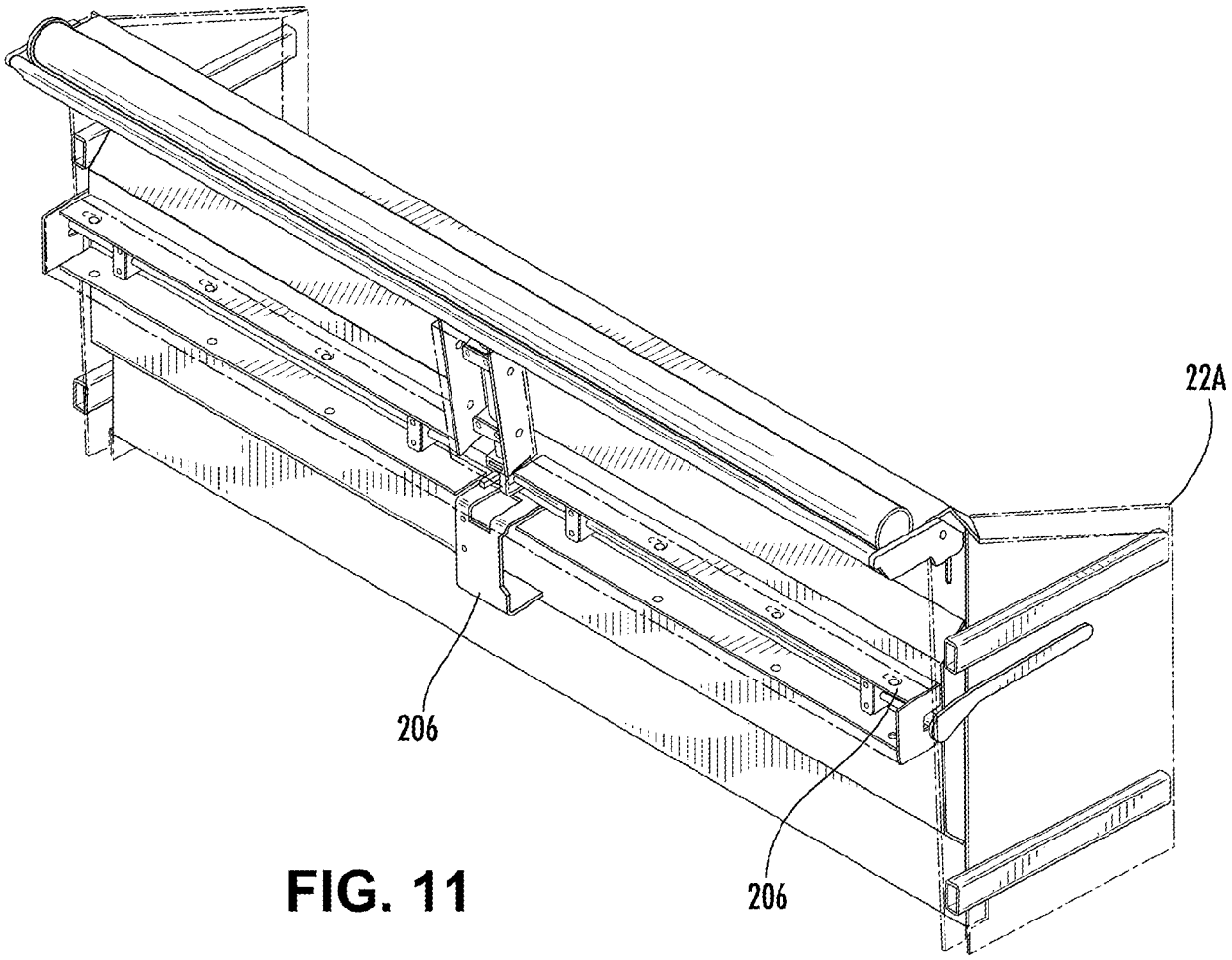
FIG. 11 is a bottom perspective view of an underside of a feed tray illustrating the covers and override lever according to another embodiment of the present invention.
Figure 12A:
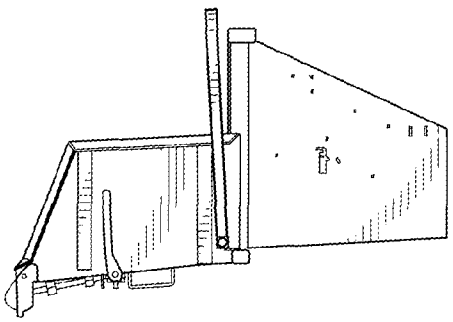
FIG. 12A illustrates a side view of the infeed tray of FIG. 12.
Figure 12C:
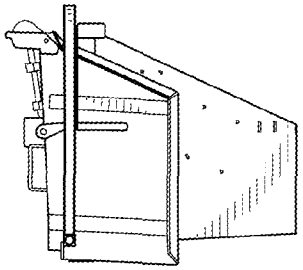
FIG. 12C illustrate a side view of the infeed tray of FIGS. 12A-B, with the infeed tray in a folded position.
Figure 12:
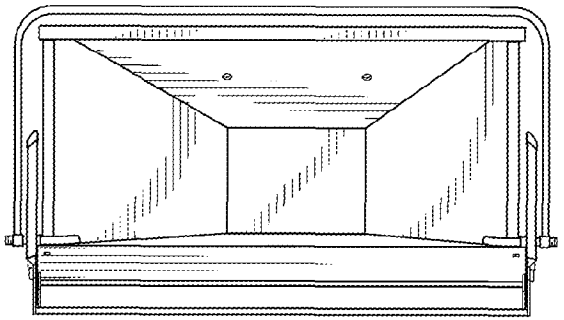
FIG. 12 illustrates a front view according to another embodiment of the present invention.
Figure 12B:
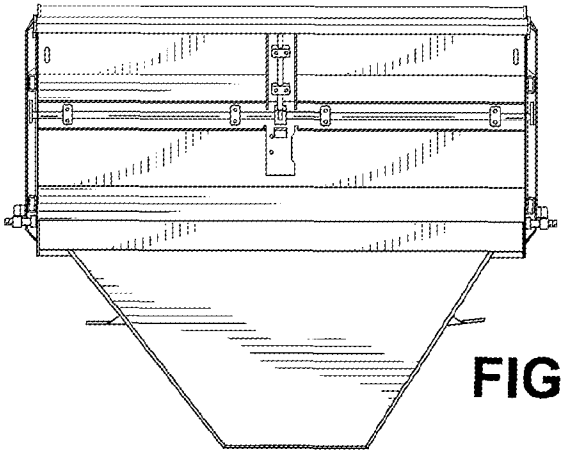
FIG. 12B illustrates a bottom view of the infeed tray of FIG. 12.
Figure 13:
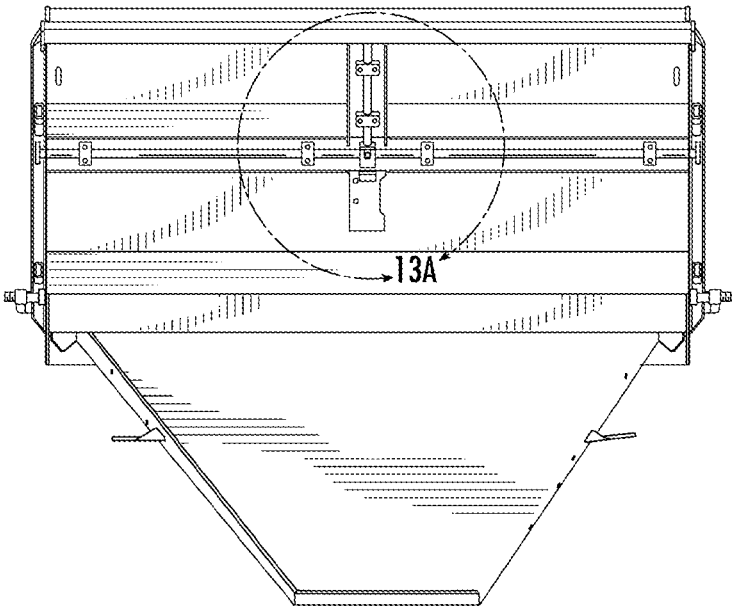
FIG. 13 illustrates the bottom view of FIG. 12B.
Figure 13A:
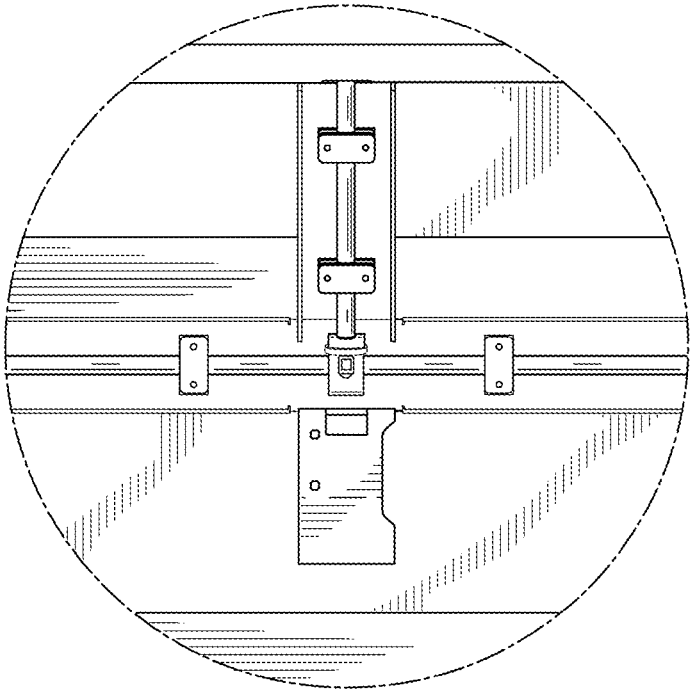
FIG. 13A illustrates an enlarged partial view of FIG. 13.

FIG. 10 illustrates an exemplary embodiment of the components of the retrofittable kit 200 of FIG. 9 mounted to an exemplary infeed tray 22 and FIG. 11 illustrates another exemplary embodiment of the components of the retrofittable kit 200A.

As detailed herein, the control system 50 of the present invention is completely mechanical in its operation and does not rely on electronic systems or electronic switches to accomplish its objectives. As such, complexity is reduced and reliability increased. Further yet, because of its wholly mechanical nature, the control system is able to be retrofitted to existing waste processing machines by simply interposing the control system 50 (to wit, actuator 60, linkage 70, and valve 80) in-between the existing chippers hydraulic feed system. In this manner a kit can be supplied for existing chipping systems which allows for the increased safety of such existing systems.

The embodiment depicted operates independently of the feed wheel control lever 23' located on both sides and the top of the infeed hopper 24'. As such, the bottom bump bar 61 is directly and mechanically connected to a (to shift) a hydraulic selector valve 80 once the bar 61 is pushed or activated, and upon activation (e.g., movement from a first to a second position) the valve 80 is moved or activated (e.g., movement from a first to a second position) and hydraulic fluid is diverted from its normal (in-use) fluid path, to a bypass path that flows (back) to the reservoir tank 110, thereby preventing the fluid from getting to (e.g., powering) the feed wheels and thereby preventing further operation of the feed wheel(s).

Once the device is activated, one embodiment requires that the device be manually reset by way of a second actuator or switch 90 that will move or switch the selector valve 80 back to the feed position (e.g., first position) and the hydraulic fluid is then again supplied to the feed wheels and normal operation will return.

It should be understood that waste processing system 10 may comprise any suitable waste reducing machinery such as the trailerable wood chipper as seen in FIG. 1, or any other, typically, movable machinery used to chip, grind, cut, or otherwise reduce bulk products. Further, while the preferred embodiment incorporates a pair of opposed, horizontally aligned feed wheels, it is understood that any feed system may be utilized. It should be further understood that this disclosure describes certain structures and operations with respect to a hydraulic system, however, other powering systems may also be utilized. Still further, the waste processing system 10 is described and illustrated as being operated by an internal combustion engine, however, the system may also be powered by any other suitable method, including, but not limited to, electricity, gas, diesel, or a power take-off from an auxiliary power source, without departing from the scope of this invention. In general, cutting system 30, feed system 25, and power source 18 are known in the art. Further, it is to be understood that numerous configurations of these known devices may be used and the description herein is not meant to be limiting with respect to these systems, unless otherwise noted, and equivalent components may be used.

It should be further understood that this disclosure describes the structure and operation of a safety and control system 50 with respect to a hydraulic system, however, other powering systems may also be utilized.

While a linear sequence of events has been described, it should be appreciated that various modifications can be made therein and, as such, the system does not necessarily require a linear sequence of events. It is also to be understood that various modifications may be made to the system, it sequences, methods, orientations, and the like without departing from the inventive concept and that the description contained herein is merely a preferred embodiment and hence, not meant to be limiting unless stated otherwise.

The solutions offered by the invention disclosed herein have thus been attained in an economical, practical, and facile manner. To wit, a novel control system which is cost effective, easily installed, strong, and aesthetically pleasing has been invented. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to be appreciated that various changes, rearrangements, and modifications may be made therein, without departing from the scope of the invention as defined by the claims.

The invention claimed is:

1. A control system comprising:

a wood chipper having a powered cutting system, a hydraulically powered feed system, and an infeed tray comprising a feedforward side for receiving wood material and a rearward side opposite the feedforward side adapted to allow the wood material to enter the hydraulically powered feed system;

an actuator comprising an elongated bar mounted to the infeed tray of the wood chipper and extending between opposite sides near the feedforward side of the infeed tray with the actuator having at least a first position and a second position;

a hydraulic valve fluidly positioned along an underside of the infeed tray, the hydraulic valve connected to the feed system and comprising a mechanical input with the valve adapted to permit operation of the feed system when the actuator is in the first position, and interrupt operation of the feed system when the actuator is in the second position;

a lever coupled to the mechanical input of the valve with the lever adapted to be actuated when the actuator is in the second position to manually reset the control system and permit operation of the feed system; and a linkage system coupling the actuator and the hydraulic valve, and coupling the lever and the hydraulic valve with the linkage system comprising a first link positioned on and extending along the underside of the infeed tray from the actuator towards the rearward side of the infeed tray, and a second link positioned on the underside of the infeed tray.

2. The control system according to claim 1 wherein:

the linkage comprises an elongated rod having a first end coupled to the actuator, and a second end mechanically coupled to the mechanical input of the valve.

3. The control system according to claim 1 wherein:

the actuator comprises a biasing device for biasing the actuator to the first position.

4. The control system according to claim 1 wherein the linkage further comprises:

a first end coupled to the actuator;

a second end mechanically coupled to the mechanical input of the valve; and wherein the linkage moves substantially linearly to alternate the valve between a first position and a second position.

5. The control system according to claim 1 wherein:

the linkage further comprises a turnbuckle comprising at least one internally threaded end.

6. The control system according to claim 5 wherein:

at least one of the ends of the turnbuckle comprises an enlarged pad.

7. The control system according to claim 1 wherein:

the valve diverts hydraulic fluid from the feed system to a hydraulic storage tank when the actuator is moved from the first position to the second position.

8. A wood chipper comprising:

a hydraulically powered feed system comprising one or more feed wheels;

an infeed tray comprising a feedforward side for receiving wood material and a rearward side opposite the feedforward side adapted to allow the wood material to enter the hydraulically powered feed system;

an actuator mounted to the infeed tray of the wood chipper and having at least a first position and a second position;

a control valve having a mechanical input and in fluid communication with the one or more feed wheels, adapted to interrupt operation of the one or more feed wheels in response to actuation of the mechanical input of the control valve;

a linkage positioned along an underside of the infeed tray and comprising:

(a) a first end coupled to the actuator positioned near the feedforward side of the infeed tray;

(b) a second end coupled to the mechanical input of the control valve;

(c) wherein the linkage moves substantially linearly to actuate the control valve when the actuator moves between the first position and the second position;

a lever adapted to be actuated with the actuator in the second position to manually move the actuator and the linkage from the second position to the first position; and a mechanical link positioned along an underside of the infeed tray and coupling the lever and the mechanical input of the control valve.

9. A wood chipper comprising:

a powered cutting system, a hydraulically powered feed system comprising one or more feed wheels, and an infeed system comprising an infeed tray and an infeed chute;

an actuator comprising an elongated bar hingedly affixed to a forward feed side of the infeed tray and having at least a first position and a second position, the second position engageable upon an operators input, the actuator further comprising a biasing device for biasing the bar to the first position;

a control valve in fluid communication with the one or more feed wheels, the valve mounted to the infeed chute of the wood chipper, the valve adapted to permit hydraulic fluid to flow within the hydraulically powered feed system so as to allow operation of the one or more feed wheels when in a first position, and adapted to divert hydraulic fluid from the hydraulically powered feed system to a reservoir, thereby diverting hydraulic power from the one or more feed wheels when in a second position, the second position being set in response to a mechanical input;

a turnbuckle operatively interlinking the actuator and the mechanical input of the valve thereby providing a direct mechanical connection between the actuator to the valve such that when the actuator is the first position the valve is not acted upon and remains in the first position, and when the actuator is moved to the second position the linkage transmits and moves the valve to the second position;

wherein the control valve must be manually reset from the second position to the first position, by an operator, via a lever.

10. The wood chipper according to claim 1 wherein:

the linkage comprises a turnbuckle operatively interlinking the actuator and the mechanical input of the valve.

11. A wood chipper comprising:

an infeed tray comprising a first side opposite a second side and separated by a feedforward side for receiving wood material and a rearward side opposite the feedforward side adapted to allow the wood material to enter a hydraulically powered feed system;

an actuator having at least a first and second position, the actuator comprising an elongated bar extending from the first side of the infeed tray to the second side of the infeed tray, and along a bottom of the infeed tray;

a hydraulic valve adapted to provide hydraulic fluid to the feed system thereby powering the feed system when the actuator is in a first position, and removing power from the feed system when the actuator is in a second position;

a first lever operably coupled to the hydraulic valve and positioned near the first side of the infeed tray;

a second lever operably coupled to the hydraulic valve and positioned near the second side of the infeed tray; and a linkage system coupling the actuator and the hydraulic valve, and coupling the first and second levers and the hydraulic valve with the linkage system comprising a first link positioned on and extending along the underside of the infeed tray from the actuator towards the rearward side of the infeed tray, and a second link positioned on the underside of the infeed tray.

12. The wood chipper according to claim 11 further comprising: a second elongated bar extending from the first side of the infeed tray to the second side of the infeed tray, and along a bottom of the infeed tray with the first and second levers coupled to opposing ends of the second elongated bar with the linkage system coupled to the second elongated bar.

13. The control system according to claim 1 wherein:

the actuator is adapted to be pivoted between the first and second positions with the pivotal motion of the actuator resulting in substantially linear motion of the linkage along the underside of the infeed tray.

14. The wood chipper according to claim 11, further comprising: a turnbuckle coupled to the elongated rod and adapted to adjust a length of the linkage.

15. The control system according to claim 1 wherein the lever comprises a pair of levers.

* * * * *